US008671732B2

(12) United States Patent
Chen

(10) Patent No.: US 8,671,732 B2
(45) Date of Patent: Mar. 18, 2014

(54) OIL-PRESSURE SWAGING TOOL FOR REBUILDING A CONNECTING PIPE

(76) Inventor: Yong-Hua Chen, Taichung (TW)

( * ) Notice: Subject to any disclaimer, the term of this patent is extended or adjusted under 35 U.S.C. 154(b) by 196 days.

(21) Appl. No.: 13/437,932

(22) Filed: Apr. 3, 2012

(65) Prior Publication Data

US 2013/0255348 A1 Oct. 3, 2013

(51) Int. Cl.
*B21D 37/20* (2006.01)

(52) U.S. Cl.
USPC ..... 72/453.01; 72/481.2

(58) Field of Classification Search
USPC ..... 72/367.1, 370.1, 370.13, 370.22, 412, 72/453.01, 453.05, 453.06, 453.08, 72/453.18, 466.7, 467, 481.2
See application file for complete search history.

(56) References Cited

U.S. PATENT DOCUMENTS 2,726,704 A * 12/1955 Fischer ..... 72/412
3,096,876 A * 7/1963 Scudieri ..... 72/453.01
4,967,468 A * 11/1990 Vossbrinck et al. ..... 29/890.031
5,782,128 A * 7/1998 Barjesteh et al. ..... 72/481.2

* cited by examiner

*Primary Examiner* — Teresa M Ekiert

(57) ABSTRACT

An oil-pressure swaging tool for rebuilding a connecting pipe includes an abutting member abutting against an oil-pressure device, a connector inserted into a connecting pipe, one end of a first axial member passing through the abutting member to connect to one end of the connector, another end of the first axial member connected to the oil-pressure device, a rebuilding member assembled to another end of the connecting pipe, a pressure collar adjacent to one end of the rebuilding member, one end of a second axial member passing through the rebuilding member to connected to the pressure collar, another end of the second axial member connected to another end of the connector. Therefore, when the opening of the connecting pipe is rebuilt by the oil-pressure swaging tool of the present invention, one end of the connecting pipe is not necessary to abut against a wall because of the abutting member.

3 Claims, 7 Drawing Sheets

OIL-PRESSURE SWAGING TOOL FOR REBUILDING A CONNECTING PIPE

BACKGROUND OF THE INVENTION

1. Field of the Invention

The present invention relates to an oil-pressure swaging tool, and more particularly to an oil-pressure swaging tool for rebuilding a connecting pipe.

2. Description of Related Art

A pipe is a tubular section or a hollow cylinder, and a cross-section of the pipe is usually circle-shaped. The pipe is mainly used to convey fluids (such as liquids, gases, slurries and powders). The pipe is usually made of metal (such as iron and steel . . . etc.) so as to be further used for a factory building or other structural applications. However, if the pipe conveying an acidic substance or an alkaline substance, the pipe which is made of metal is often eroded by those chemical substances and going to damage someday. In order to solve this problem, a user usually cuts the damaged part of the pipe away so that the pipe is separated into two parts. Then, the user uses a conventional swaging tool to adjust a connecting pipe so that two ends of the connecting pipe are matching to each of parts respectively. Finally, the connecting pipe is connected between the two parts of the pipe.

The conventional swaging tool comprises a body. The body has a hold lever for the user to hold. A sleeve is formed on the top of the body. A positioning ring is mounted to a front end of the sleeve. An enlarging member is enclosed by the positioning ring. The enlarging member has a cone-shaped hole defined at the center thereof. An operation lever is set to a rear end of the sleeve. The operation lever has a pressure part and a release part. An awl is enclosed by the sleeve. The awl has a cone head at the front end thereof. The awl moves forward when the pressure part of the operation lever presses the awl. Thereafter, the cone head of the awl is inserted into the cone-shaped hole of the enlarging member via the motion of the awl, so that the enlarging member is enlarged by the cone head to rebuild the opening of the connecting pipe.

Under this arrangement, the user inserts the enlarging member of the conventional swaging tool into the opening of the connecting pipe at first, and then pushes the operation lever. Finally, the opening of the connecting pipe is enlarged by the enlarging member so that the opening of the connecting pipe is rebuilt to fit the opening of the pipe. Unfortunately, the conventional swaging tool still has three disadvantages as following:

First, if the material of the connecting pipe is too stiff to rebuild the opening of the connecting pipe with the conventional swaging tool directly, the user often calcines the end of the connecting pipe to soften the peripheral wall of the connecting pipe at first; and then the user uses the conventional swaging tool to rebuild the opening of the connecting pipe; finally, after the connecting pipe solidifies, the opening of the connecting pipe is rebuilt. However, a plurality of outside particles is often adhered to the surface of the connecting pipe before the connecting pipe is solidified. Thus, the surface of the rebuilt connecting pipe is very rough.

Second, when the user uses the conventional swaging tool to rebuild the opening of the connecting pipe, the user inserts the enlarging member into the opening at one end of the connecting pipe and another end of the connecting pipe is often abutted against a wall. However, if the connecting pipe is long, it is very inconvenient to abut another end of the connecting pipe against a wall. Furthermore, if the inserting direction of the enlarging member is shifted, the enlarging force from the enlarging member to the periphery of the connecting pipe would be not uniform so that the rebuilt opening of the connecting pipe would be not round completely and would not further fit the opening of the pipe.

Third, the conventional swaging tool only can rebuild the opening of the connecting pipe via enlarging the opening of the connecting pipe so that when the opening of the pipe is smaller than the opening of the connecting pipe, the conventional swaging tool cannot neck the opening of the connecting pipe by using the conventional swaging tool.

The present invention has arisen to mitigate and/or obviate the disadvantages of the conventional. Further benefits and advantages of the present invention will become apparent after a careful reading of the detailed description with appropriate reference to the accompanying drawings.

SUMMARY OF THE INVENTION

The main objective of the present invention is to provide an improved oil-pressure swaging tool.

To achieve the objective, an oil-pressure swaging tool for rebuilding a connecting pipe comprises an abutting member abutting against an oil-pressure device, a connector inserted into a connecting pipe, one end of a first axial member passing through the abutting member to connect to one end of the connector, another end of the first axial member connected to the oil-pressure device, a rebuilding member assembled to another end of the connecting pipe, a pressure collar adjacent to one end of the rebuilding member, one end of a second axial member passing through the rebuilding member to connected to the pressure collar, another end of the second axial member connected to another end of the connector, the rebuilding member having an oblique surface at another end thereof, the oblique surface abutting against the surface of the opening at another end of the connecting pipe.

Wherein, a circular groove is defined on the surface of the rebuilding member; the circular groove is adjacent to the oblique surface; wherein, a bottom surface of the circular groove does not contact the surface of the opening at another end of the connecting pipe when the oblique surface presses the surface of the opening at another end of the connecting pipe, so that the connecting pipe which has been rebuilt is easily to be detached from the rebuilding member; a plurality of concentric circle steps is formed at another end of the abutting member; the diameters of those concentric circle steps are decreasing inwardly; thus, the concentric circle steps of the abutting member can abut against the opening at one end of the connecting pipe with various sizes.

Therefore, the opening at one end of the connecting pipe abuts against the abutting member and the opening at another end of the connecting pipe abuts against the oblique surface of the rebuilding member; when the oil-pressure device is working, the first axial member is pulled by the oil-pressure device; then, the connector and the second axial member move toward the abutting member via the motion of the first axial member, and the pressure collar pushes the rebuilding member toward the opening at another end of the connecting pipe via the motion of the second axial member; thereafter, the oblique surface of the rebuilding member presses the surface of the opening at another end of the connecting pipe until the opening at another end of the connecting pipe is rebuilt and the oil-pressure device stops operating.

Further benefits and advantages of the present invention will become apparent after a careful reading of the detailed description with appropriate reference to the accompanying drawings.

DETAILED DESCRIPTION OF THE INVENTION

Figure 1:
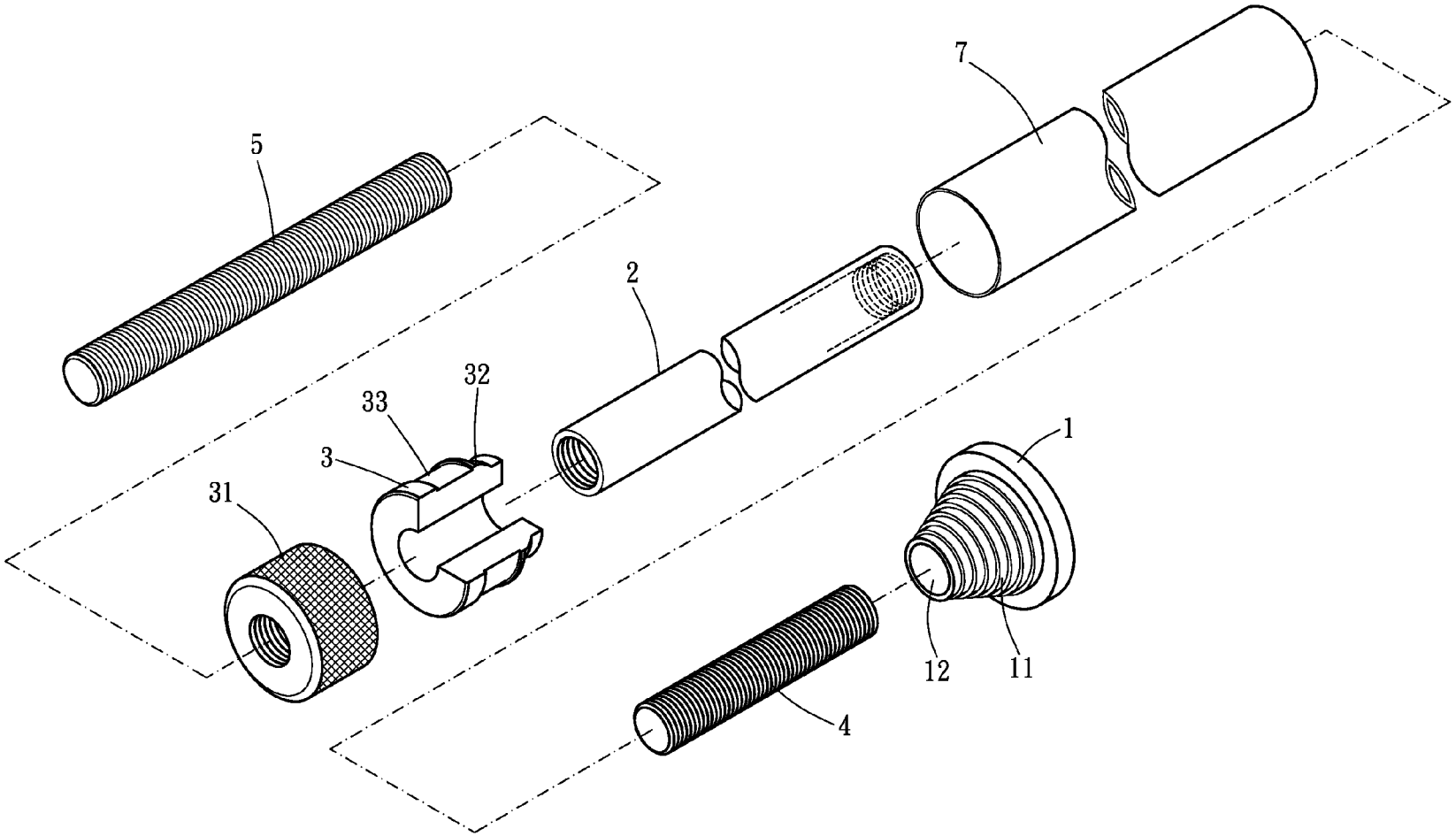
FIG. 1 is an exploded view of an oil-pressure swaging tool for rebuilding a connecting pipe of the present invention.
Figure 2:
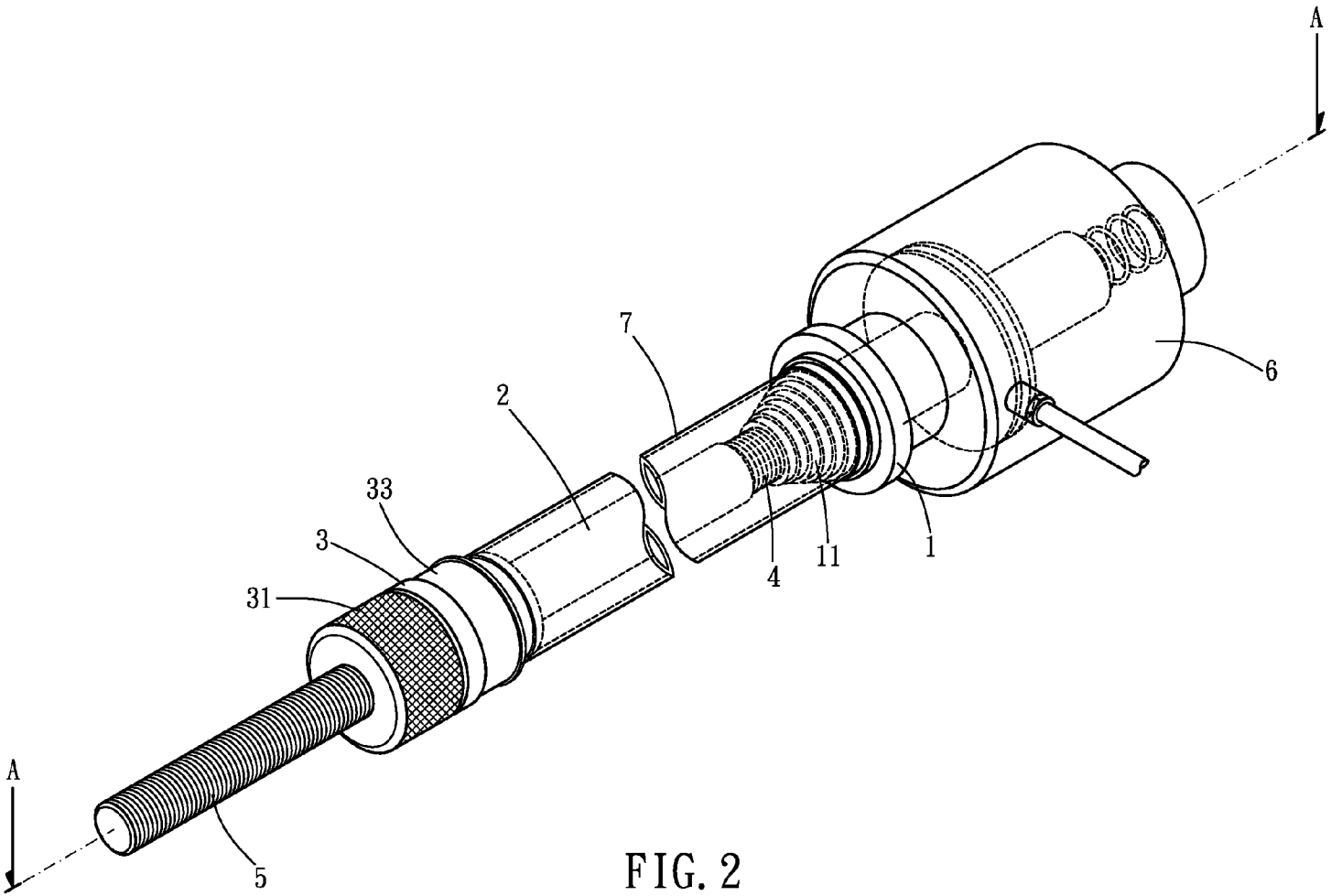
FIG. 2 is an assembled view of the oil-pressure swaging tool for rebuilding a connecting pipe of the present invention.

Referring to FIGS. 1-4, an oil-pressure swaging tool for rebuilding a connecting pipe in accordance with the present invention comprises an abutting member 1, a connector 2, a rebuilding member 3, a first axial member 4 and a second axial member 5. The abutting member 1 abuts against an oil-pressure device 6. The connector 2 is inserted into a connecting pipe 7. One end of the first axial member 4 passes through the abutting member 1 to connect to one end of the connector 2. Another end of the first axial member 4 is connected to the oil-pressure device 6. The first axial member 4 is axially movable via the oil-pressure device 6. One end of the abutting member 1 abuts against the oil-pressure device 6. A plurality of concentric circle steps 11 is formed at another end of the abutting member 1 so that the abutting member 1 is formed as a cone-shape. The diameters of those concentric circle steps 11 are decreasing inwardly. Therefore, the concentric circle steps 11 of the abutting member 1 can abut against the opening at one end of the connecting pipe 7 with different sizes. A through hole 12 is opened at the center of the abutting member 1. The surface of the first axial member 4 is threaded so that one end of the first axial member 4 passes through the through hole 12 of the abutting member 1 to be screwed to one end of the connector 2. The first axial member 4 is axially movable via the oil-pressure device 6. Therefore, when the first axial member 4 is moved by the oil-pressure device 6, the first axial member 4 moves relative to the abutting member 1 and the connector 2 is moved by the motion of the first axial member 4.

Figure 3:
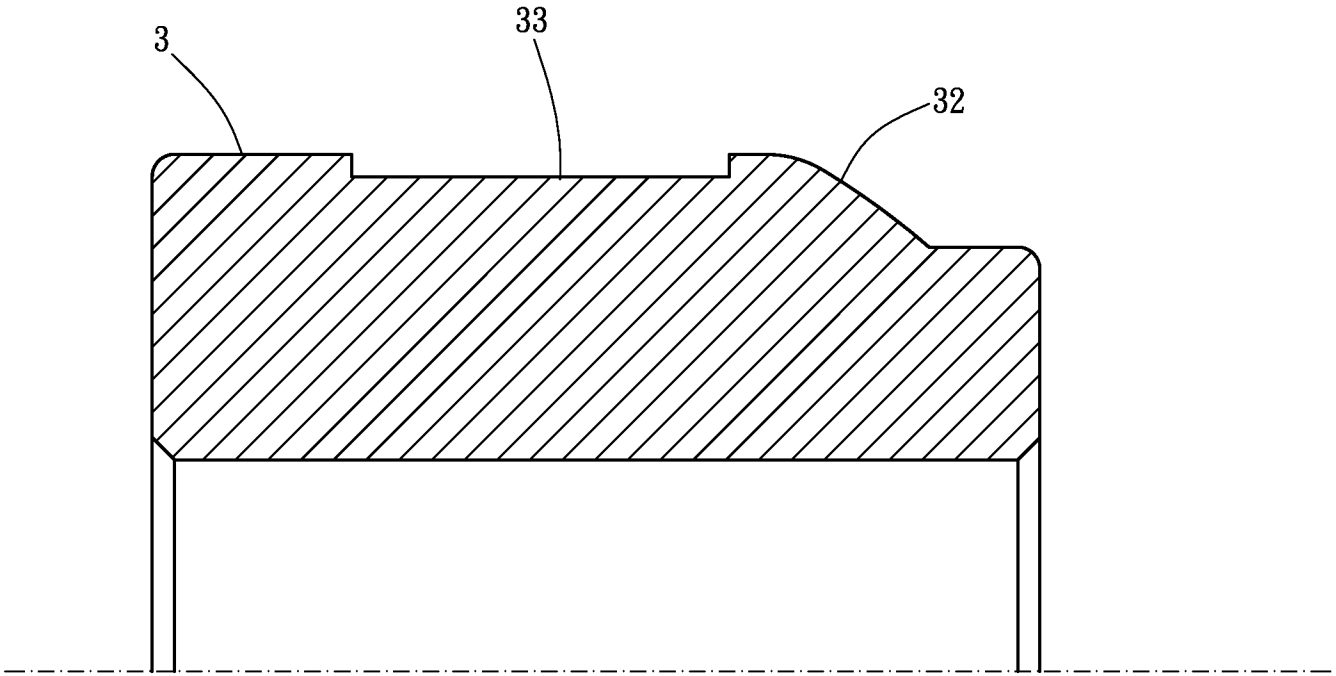
FIG. 3 is a partially enlarged view for showing a cross-section of a rebuilding member along line AA in FIG. 2.
Figure 4:
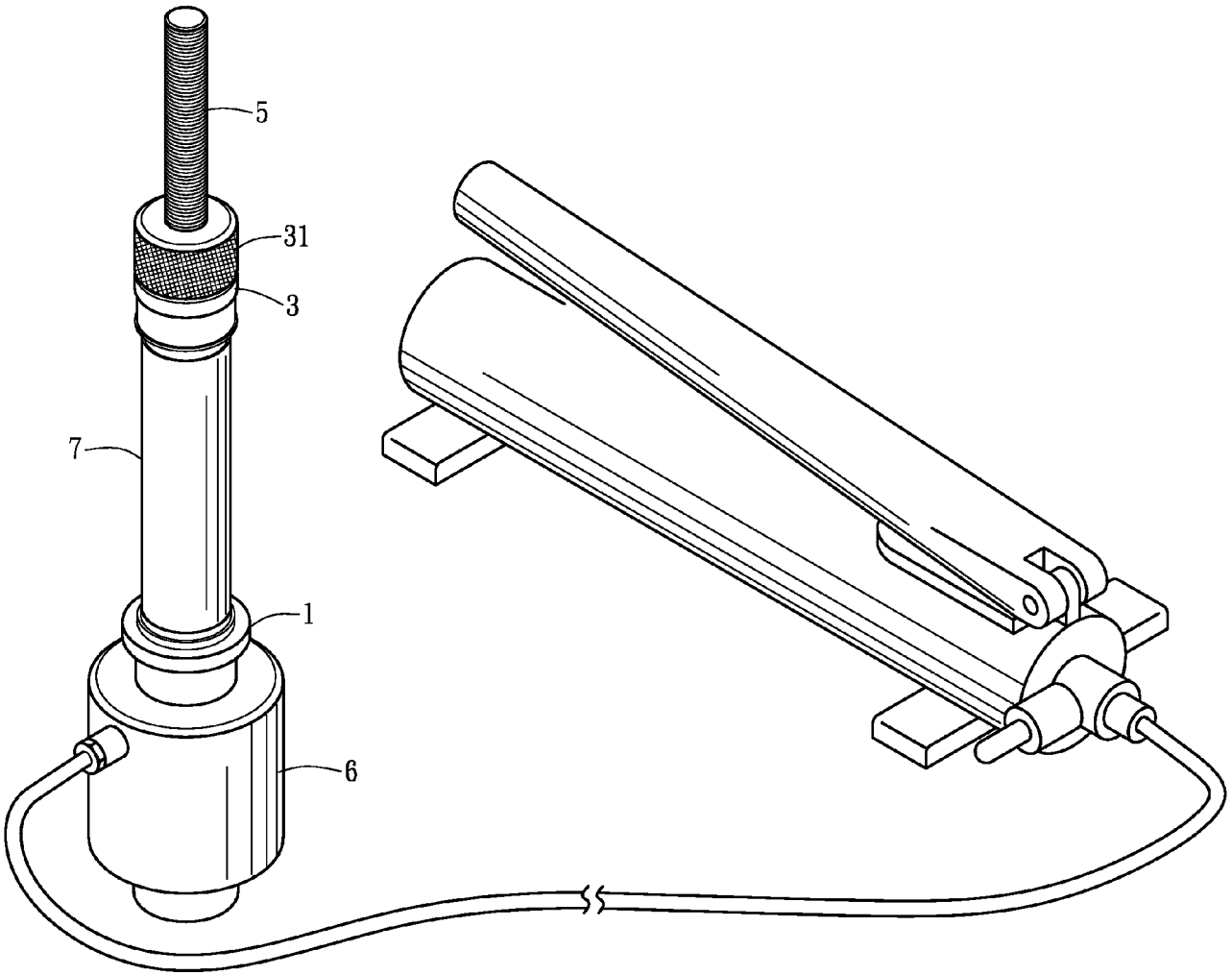
FIG. 4 is a perspective view for showing the oil-pressure swaging tool connected to an oil-pressure device.
Figure 5:
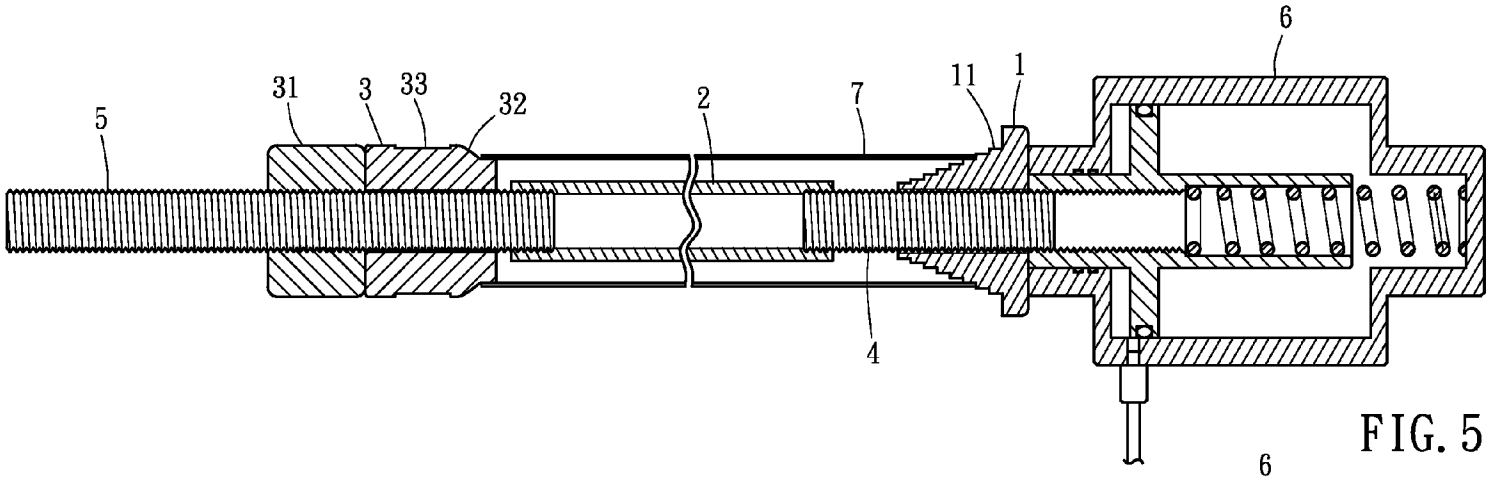
FIG. 5 is a cross-sectional view for showing the operation before rebuilding the opening of a connecting pipe along line AA in FIG. 2.
Figure 6:
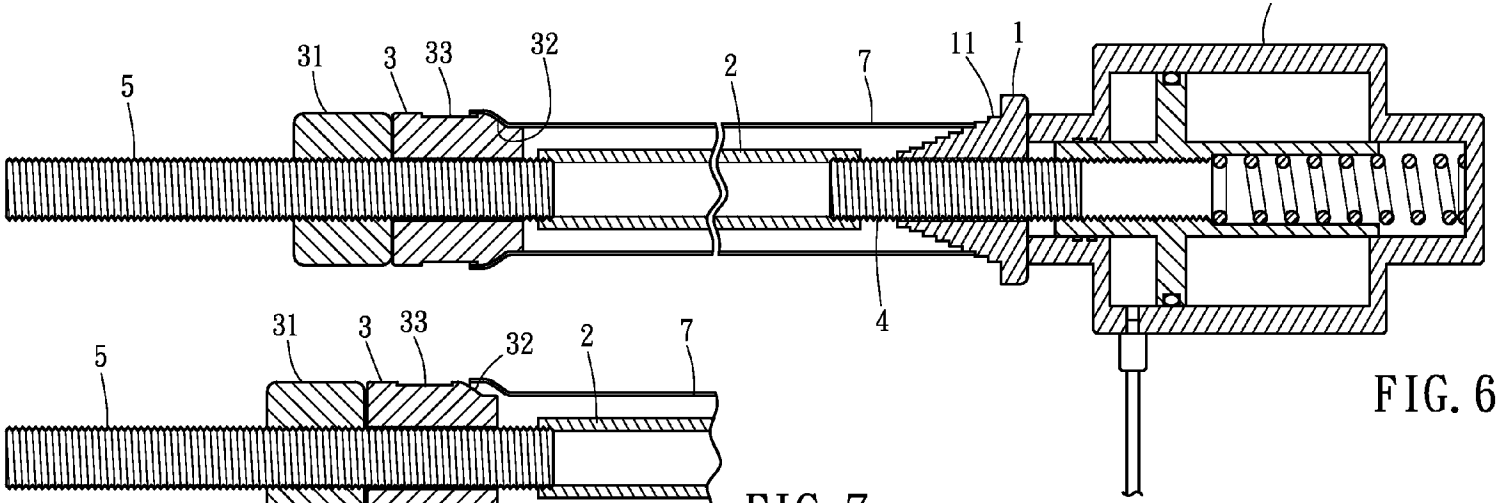
FIG. 6 is a cross-sectional view for showing the operation during rebuilding the opening of the connecting pipe along line AA in FIG. 2.

The rebuilding member 3 is assembled to another end of the connecting pipe 7. A pressure collar 31 is adjacent to one end of the rebuilding member 3. One end of the second axial member 5 passes through the rebuilding member 3 and is connected to the pressure collar 31. Another end of the second axial member 5 is connected to another end of the connector 2. The surface of the second axial member 5 is threaded so that one end of the second axial member 5 passes through the rebuilding member 3 and is further screwed to the pressure collar 31. Another end of the second axial member 5 is further screwed to another end of the connector 2. Therefore, the connector 2 is connected between the first axial member 4 and the second axial member 5 so that the connector 2, the first axial member 4 and the second axial member 5 move together. The rebuilding member 3 has an oblique surface 32 at another end thereof. The oblique surface 32 abuts against the inner surface of the opening at another end of the connecting pipe 7 (the rebuilding member 3 is a cylinder and the oblique surface 32 is defined on the outer periphery of the rebuilding member 3 as shown in FIG. 3 in this embodiment).

Figure 7:
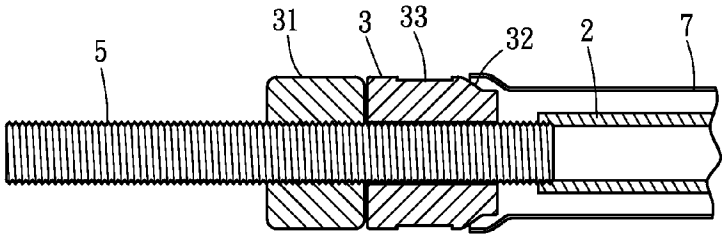
FIG. 7 is a cross-sectional view for showing the operation after rebuilding the opening of the connecting pipe along line AA in FIG. 2.
Figure 8:
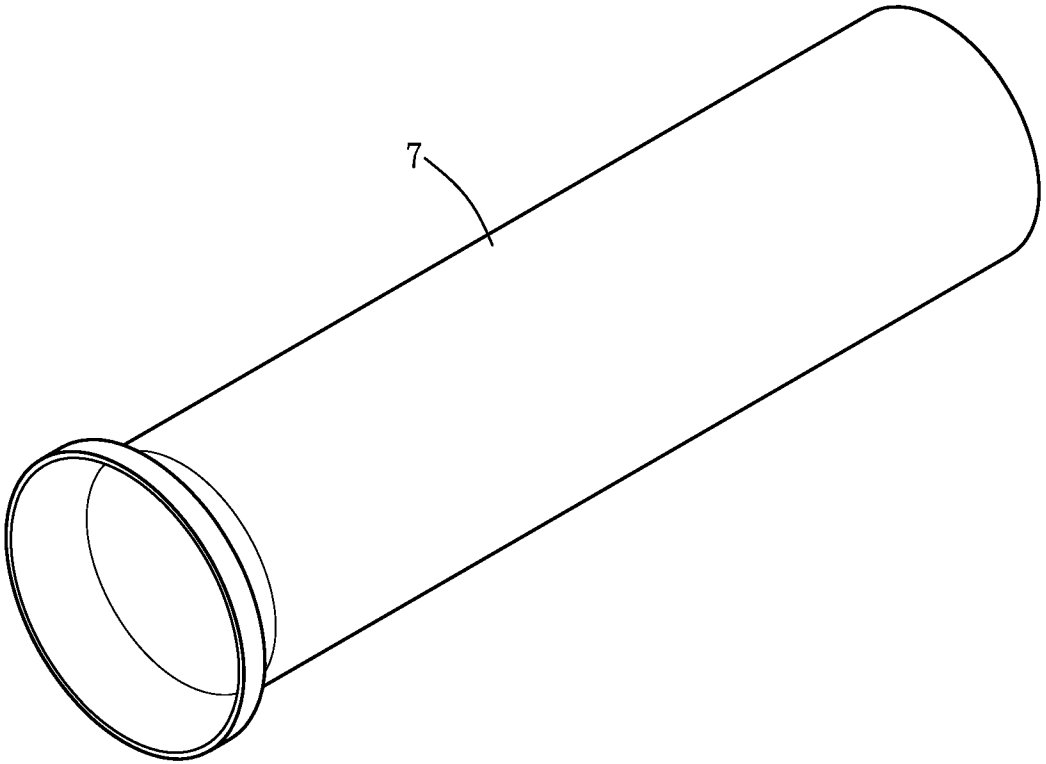
FIG. 8 is a perspective view for showing the rebuilt opening of the connecting pipe.

Referring to FIGS. 1 and 5-8, the opening at one end of the connecting pipe 7 abuts against one circle of the concentric circle steps 11 and the opening at another end of the connecting pipe 7 abuts against the oblique surface 32 of the rebuilding member 3. When the oil-pressure device 6 is working, the first axial member 4 is pulled by the oil-pressure device 6. The first axial member 4 moves relative to the abutting member 1, but the abutting member 1 tightly abuts against the oil-pressure device 6 instead of moving. Then, the connector 2 and the second axial member 5 move toward the abutting member 1 via the motion of the first axial member 4, and the pressure collar 31 pushes the rebuilding member 3 toward the opening at another end of the connecting pipe 7 via the motion of the second axial member 5. Thereafter, the oblique surface 32 of the rebuilding member 3 presses the inner surface of the opening at another end of the connecting pipe 7 until the opening at another end of the connecting pipe 7 is enlarged and the oil-pressure device 6 stops operating. Finally, a user pulls the first axial member 4 back to the original position so as to detaching the connecting pipe 7 which has been rebuilt from the abutting member 1 and the rebuilding member 3 (as shown in FIGS. 7-8).

Therefore, when the opening at another end of the connecting pipe 7 is rebuilt by the oil-pressure swaging tool of the present invention, one end of the connecting pipe 7 is not necessary to abut against a wall because of the abutting member 1. In addition, the pressure from the oblique surface 32 of the rebuilding member 3 to the inner surface of the opening at another end of the connecting pipe 7 is uniform so that the rebuilt opening at another end of the connecting pipe 7 would be completely round and would further fit the opening of an original pipe.

Furthermore, a circular groove 33 is defined on the outer surface of the rebuilding member 3. The circular groove 33 is adjacent to the oblique surface 32. A bottom surface of the circular groove 33 does not contact the inner surface of the opening at another end of the connecting pipe 7 when the oblique surface 32 presses the inner surface of the opening at another end of the connecting pipe 7, so that the connecting pipe 7 which has been rebuilt is easily to be detached from the rebuilding member 3 (as shown in FIGS. 3 and 7).

Figure 9:
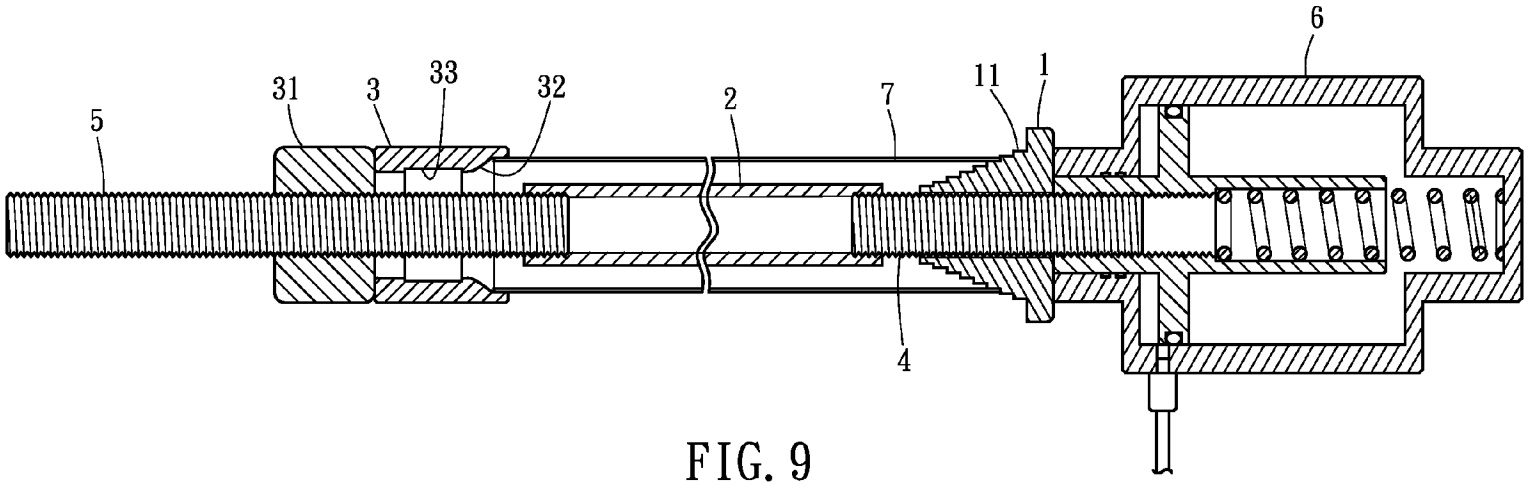
FIGS. 9-10 are cross-sectional views for showing the operation in the second embodiment.
Figure 10:
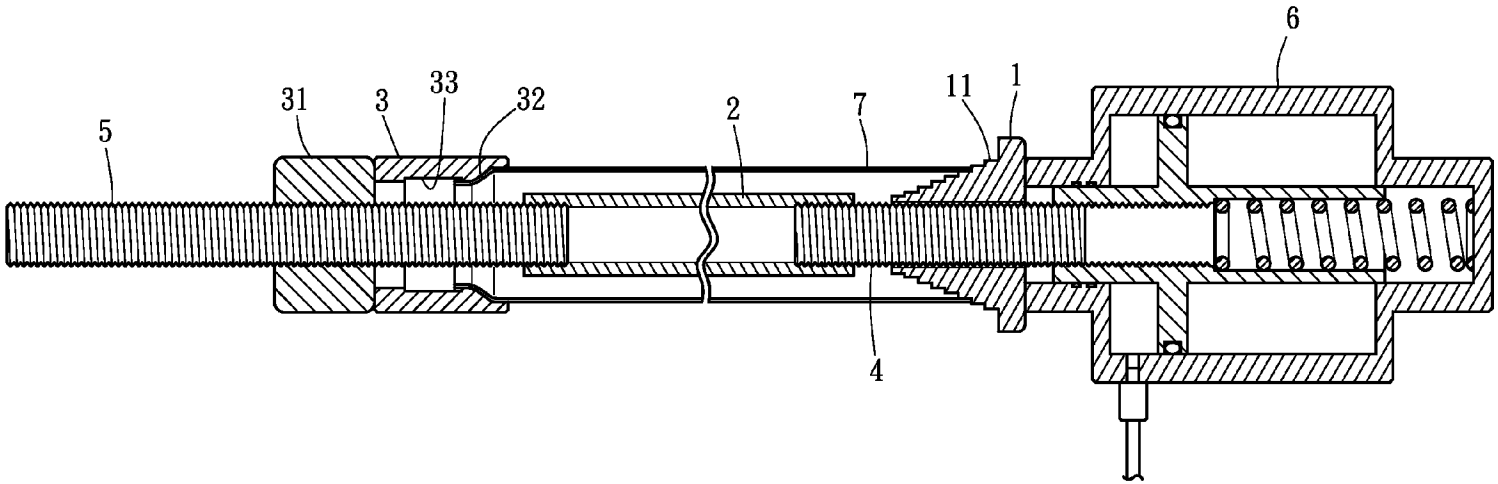

Referring to FIGS. 9-10, the second embodiment is shown as following (only the features which are different from the first embodiment would be further described). The cross-section of the rebuilding member 3 is circle-shaped and the oblique surface 32 is defined on the inner periphery of the rebuilding member 3. The circular groove 33 is defined on the inner surface the rebuilding member 3. The circular groove 33 is adjacent to the oblique surface 32. Under this arrangement, when the opening at another end of the connecting pipe 7 is rebuilt by the oil-pressure swaging tool of the present invention, the oblique surface 32 of the rebuilding member 3 presses the outer surface of the opening at another end of the connecting pipe 7 until the opening at another end of the connecting pipe 7 is necked and the oil-pressure device 6 stops operating.

All in all, the oil-pressure swaging tool of the present invention not only rebuilds the opening at another end of the connecting pipe 7 via enlarging the opening at another end of the connecting pipe 7 (as the first embodiment of the present invention), but also rebuilds the opening at another end of the connecting pipe 7 via necking the opening at another end of the connecting pipe 7 (as the second embodiment of the present invention) because of the rebuilding members 3 of the first and second embodiment.

Although the invention has been explained in relation to its preferred embodiment, it is to be understood that many other possible modifications and variations can be made without departing from the spirit and scope of the invention as hereinafter claimed.

What is claimed is:

1. An oil-pressure swaging tool for rebuilding a connecting pipe comprising:

an abutting member abutting against an oil-pressure device, a first end of the connecting pipe retained by the abutting member, a connector inserted into the connecting pipe, a first end of a first axial member passing through the abutting member and connected to a first end of the connector, and a second end of the first axial member connected to the oil-pressure device;

a rebuilding member assembled to a second end of the connecting pipe, a pressure collar adjacent to a first end of the rebuilding member opposite to the connecting pipe, a first end of a second axial member passing through the rebuilding member and connected to the pressure collar, a second end of the second axial member connected to a second end of the connector; and the rebuilding member having an oblique surface at a second end thereof, the oblique surface abutting against a surface of an opening at the second end of the connecting pipe;

wherein, when the oil-pressure device is working, the first axial member is pulled by the oil-pressure device; then, the connector and the second axial member move toward the abutting member via the motion of the first axial member, and the pressure collar pushes the rebuilding member toward the second end of the connecting pipe via the motion of the second axial member; thereafter, the oblique surface of the rebuilding member presses the surface of the opening at the second end of the connecting pipe until that is rebuilt and the oil-pressure device stops operating.

2. The oil-pressure swaging tool for rebuilding the connecting pipe as claimed in claim 1, wherein the rebuilding member is a cylinder and has a circular groove defined in an outer periphery of the rebuilding member; the circular groove is adjacent to the oblique surface; wherein, a bottom surface of the circular groove does not contact the surface of the opening at the second end of the connecting pipe when the oblique surface presses the surface of the opening at the second end of the connecting pipe, so that the connecting pipe which has been rebuilt is easily to be detached from the rebuilding member.

3. The oil-pressure swaging tool for rebuilding the connecting pipe as claimed in claim 1, wherein the abutting member has a plurality of concentric circle steps formed at one end thereof opposite to the oil-pressure device; the diameters of those concentric circle steps are decreasing inwardly; therefore, the concentric circle steps of the abutting member can abut against the opening of the connecting pipe with different sizes.

* * * * *